US005670703A

United States Patent [19]

Barendregt et al.

[11] Patent Number: 5,670,703

[45] Date of Patent: Sep. 23, 1997

[54] PROCESS AND INSTALLATION FOR PRODUCING LIQUID FUELS AND RAW CHEMICALS

[75] Inventors: Simon Barendregt, Rhoon; Jean Lucien Monfils, Noordwijk, both of Netherlands

[73] Assignee: Mannesmann Aktiengesellschaft, Düsseldorf, Germany

[21] Appl. No.: 50,169

[22] PCT Filed: Oct. 30, 1991

[86] PCT No.: PCT/DE91/00851

§ 371 Date: May 10, 1993

§ 102(e) Date: May 10, 1993

[87] PCT Pub. No.: WO92/07921

PCT Pub. Date: May 14, 1992

[30] Foreign Application Priority Data

Nov. 14, 1991 [DE] Germany ..... 40 35 274.9

[51] Int. Cl.[6] ..... C07C 5/03

[52] U.S. Cl. ..... 585/324; 585/310; 585/314; 585/654; 568/697; 196/105

[58] Field of Search ..... 585/310, 34, 324, 585/654; 568/697; 196/105

[56] References Cited

U.S. PATENT DOCUMENTS

| | | | |
|---|---|---|---|
| 4,546,204 | 10/1985 | Parris | 585/314 |
| 4,569,753 | 2/1986 | Busch et al. | 208/73 |
| 4,581,474 | 4/1986 | Hutson, Jr. et al. | 585/314 |
| 5,001,292 | 3/1991 | Harandi et al. | 585/310 |
| 5,023,389 | 6/1991 | Grandvallet et al. | 585/314 |
| 5,254,748 | 10/1993 | Hensley et al. | 585/314 |
| 5,254,764 | 10/1993 | Micracca et al. | 585/310 |

*Primary Examiner*—Helane Myers

*Attorney, Agent, or Firm*—Cohen, Pontani, Lieberman & Pavane

[57] ABSTRACT

The invention is directed to a process and an installation for the production of liquid fuels and raw chemicals from crude petroleum within the framework of a refinery process with process steps for distillation, thermal and/or catalytic cracking, and possibly reformation. The refinery process is directly supplemented by various process steps, i.e. a partial flow of the $C_4$ components together with a flow of methanol or ethanol is subjected to a catalytic reaction, the unconverted n-butane-containing portion of the components is subjected to isomerization, a part of the isobutane is subjected to a thermal cracking process, and finally the product flow emerging therefrom is guided back, in its entirety or in part, into the fractionation stage for splitting.

11 Claims, 3 Drawing Sheets

PROCESS AND INSTALLATION FOR PRODUCING LIQUID FUELS AND RAW CHEMICALS

BACKGROUND OF THE INVENTION

The invention concerns a process and an installation for producing liquid fuels and raw chemicals from crude petroleum within the framework of a refinery process.

A refinery process conventionally includes a combination of numerous physical and chemical partial processes. Among these are particularly the processes for distillation (at various pressures), catalytic reformation, hydrorefining, and the cracking of higher hydrocarbons. In the following, the hydrocarbons are abbreviated and designated, depending on the number of carbon atoms, by $C_2$, $C_3$, $C_4$, $C_5^+$(five or more carbon atoms).

A rough diagram of such a refinery process, according to the prior art, is shown in FIG. 1. In a distillation unit (DEST), crude petroleum (CRUDE) is split into a series of different fractions which are generally not homogeneous materials, but rather mixed products.

A relatively light fraction ($C_1$–$C_{10}$, $H_2S$) exits the distillation unit as head product and is separated into a gaseous phase and a liquid phase in a storage vessel (ACCU). The lightest components ($C_1$, $C_2$, $H_2S$) are fed to an installation (ASR) in which sulfur is removed by amines. The resulting products are a gas flow G and a quantitative flow (S) of sulfur.

The heavier components (raw naphtha, predominantly $C_3$ to $C_{10}$) are fed to a naphtha hydrating treatment (VNHDT) from the storage vessel (ACCU), but can also be sold directly as raw chemicals or feedstock (CF). The naphtha hydrating treatment produces a marketable naphtha (NA), but this can also be processed further by means of catalytic reformation (CREF) in which in particular a hydrogen-rich gas ($H_2R$) and gasolines (reformates REF, predominantly $C_{5-C10}$) are formed. For the rest, mixtures of material comprising liquid gas (LPG) (predominantly $C_3$ and $C_4$) occur in the naphtha hydrating treatment (VNHDT) and in the catalytic reformation (CREF). Some $C_5$ components can also be removed from the naphtha hydrating treatment (VNHDT). These intermediate products (predominantly $C_3$–$C_5$) are then divided into various fractions in a fractionating installation (VRU). The remaining gaseous components which are still contained (particularly $H_2$, CO, $CO_2$, $C_1$, $C_2$) are fed to the aforementioned gas flow G, while the other fractions ($C_3$, $C_4$, $C_5$) are further processed to form various gasoline products (GP) in subsequent (parallel) process steps (AIDP) which can include alkylation, isomerization, dimerization, as well as polymerization.

The kerosine and diesel fractions which are separated out in the distillation unit (DEST) are subjected to desulfurization and hydration (HDS) respectively, whereupon they represent salable products.

The lighter part of the heavy hydrocarbons is fed to a catalytic cracking installation (FCC), but can also be used as heavy fuel oil (FO). The bottom product of the distillation unit (DEST) is likewise supplied to the catalytic cracking installation (FCC) after undergoing vacuum distillation (VDEST). If necessary, cracking can also be effected accompanied by the addition of hydrogen. The resulting gaseous fraction ($C_1$, $C_2$, $NH_3$, $H_2S$) is guided into the ASR installation, while the liquid gas components ($C_3$, $C_4$) are directed into the fractionating installation (VRU) as LPG. If diesel proportions occur they are fed to the diesel flow (DIE). The essential end product formed in the cracking installation (FCC) is a flow of high-grade motor gasoline (FCCG). The remaining heavy hydrocarbons, as well as the bottom product occurring in the vacuum distillation (VDEST) which can be additionally subjected to a thermal cracking process (VISBR), are used as heavy fuel oil (FO).

FIG. 2 shows a similar refinery process also belonging to the prior art. In this case, instead of a catalytic cracker (FCC), a hydrocracker (HYCR) is used which supplies cracked products of different quality and quantitative composition. The latter are fed to similar or related end product or intermediate product flows occurring in other places in the refinery process. A flow of $C_3$components and $C_4$ components as well as a flow of gasoline products ($C_5^+$) result as end products in the fractionating installation (VRU). An immediate further processing of the gasolines as shown in FIG. 1 is not provided in this instance, but of course can also take place.

The gasoline products produced in the refinery process normally contain further significant proportions of dissolved butane. For environmental reasons, there is a growing demand to reduce the content of highly volatile butane in gasolines to a comparatively small residual quantity. Corresponding legal regulations already exist in the United States and are also anticipated in other countries. Measures for reducing the butane content are known. However, the question remains of how this surplus butane can be used in the most productive manner. Burning off, which is still frequently carried out in crude petroleum extraction, is doubtless the least desirable "use". However, the obvious use for generating process steam is also not always advisable, as there is often no need for the additionally generated steam. Moreover, this is not desirable for economic reasons because a relatively valuable raw material is eliminated by burning.

Further processing of butane to form useful products is generally known. Among these products are e.g. gasoline additives for increasing the octane number which are used as an alternative to lead compounds which were formerly used for this purpose. For environmental reasons, the use of lead compounds is increasingly restricted. Instead, materials such as MTBE (tert-butyl methyl ether) and ETBE (tert-butyl ethyl ether) are used, which are normally produced in separate large-scale installations. Butane is used as starting material, its n-butane proportion first being converted into isobutane and then into isobutylene. This conversion takes place in the form of a catalytic process. Thermal cracking of isobutane is also known in general, whereby, in addition to isobutylene, proportions of propylene and ethylene are also formed in particular. The latter cannot be used for the production of MTBE or ETBE.

MTBE and ETBE are actually produced by converting isobutylene with methanol or ethanol, respectively, in the presence of acidic catalysts (e.g. ion exchangers).

An obvious possibility for exploiting the surplus butane occurring in the refinery process therefore consists in using this butane as input material in such large-scale installations. However, the cost required for transporting the butane (e.g. pipeline or tank vehicles) is already a considerable disadvantage.

SUMMARY OF THE INVENTION

The invention has the object of suggesting the possibility for exploitation which is most advantageous with respect to environmental protection and in technical and economic respects.

BRIEF DESCRIPTION OF THE DRAWINGS

The invention is described in more detail in the following with reference to FIGS. 1 to 3.

DETAILED DESCRIPTION OF THE PREFERRED EMBODIMENTS

Figure 1:
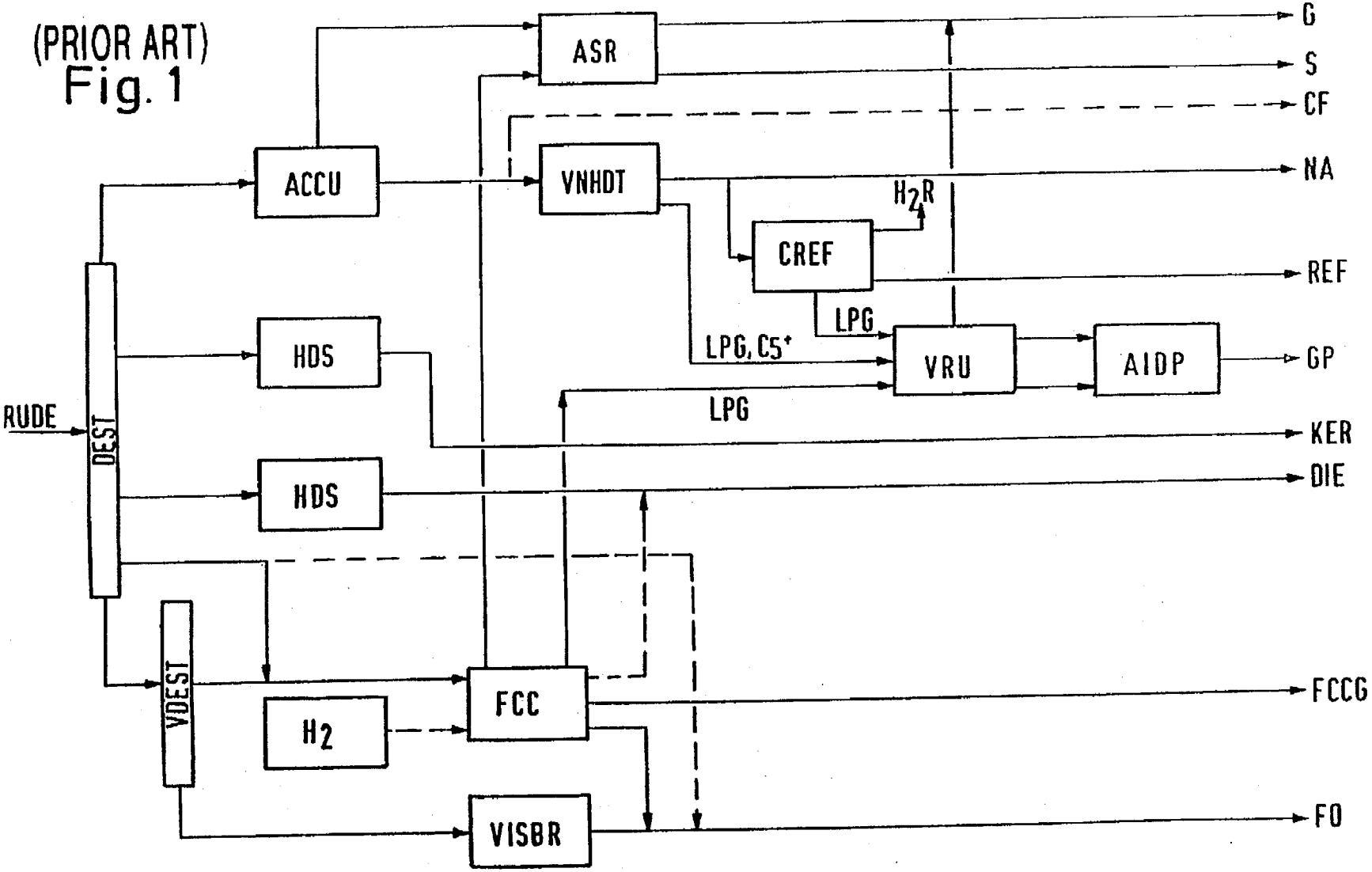
(PRIOR ART) Fig. 1
FIG. 1 and 2 show conventional refinery processes with fluid bed cracking (FCC) and a hydrocracker (HYCR), respectively.
Figure 2:
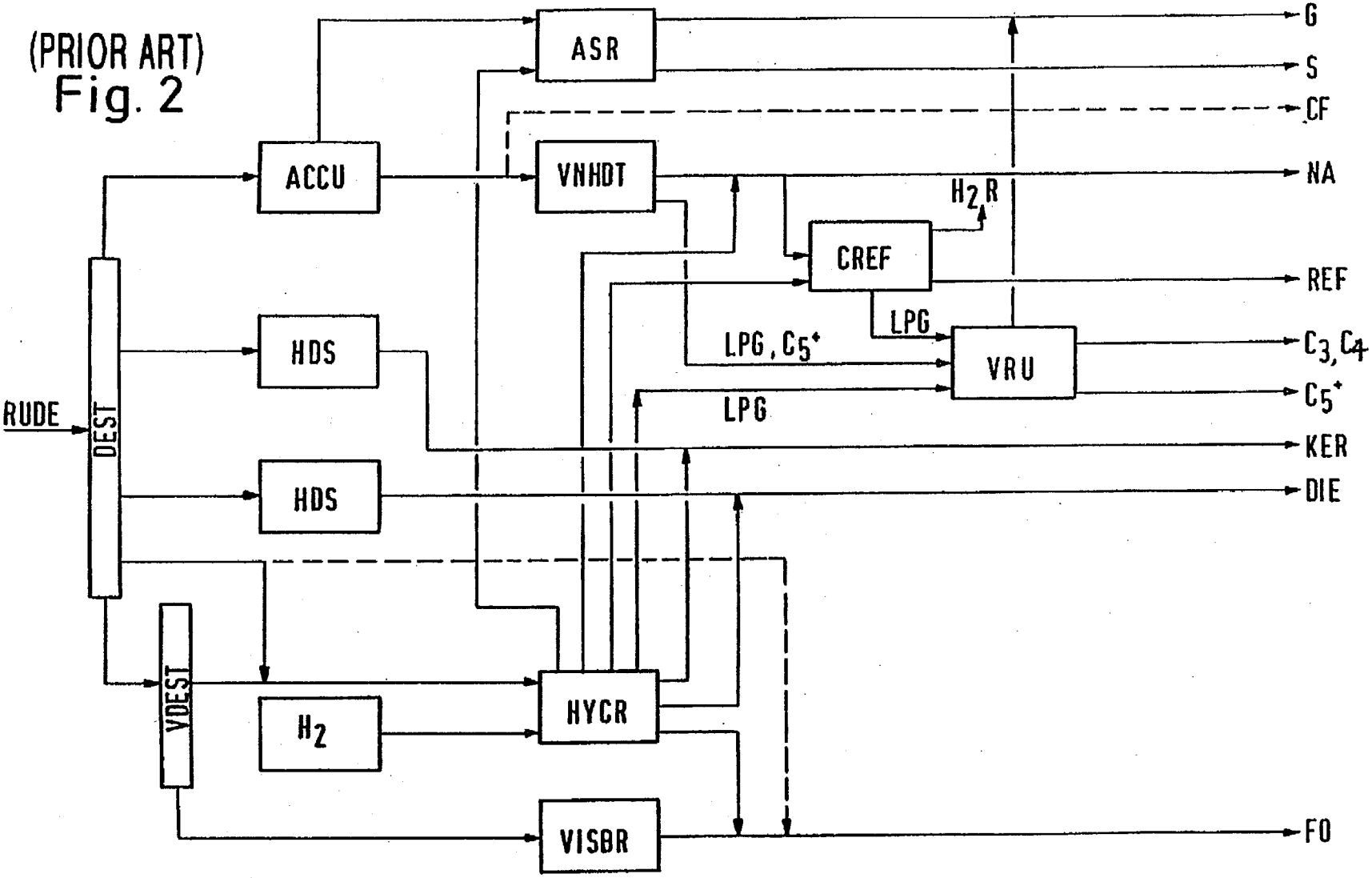
(PRIOR ART) Fig. 2

Since FIG. 1 and 2 have already been discussed in detail in the preceding, they need not be addressed again. The diagram in FIG. 3, for example, can be linked to these two refinery processes. The common point between the individual figures consists in the fractionating installation (VRU); in particular, the various flows of liquid gas LPG occurring in the refinery process flow into the latter.

Figure 3:
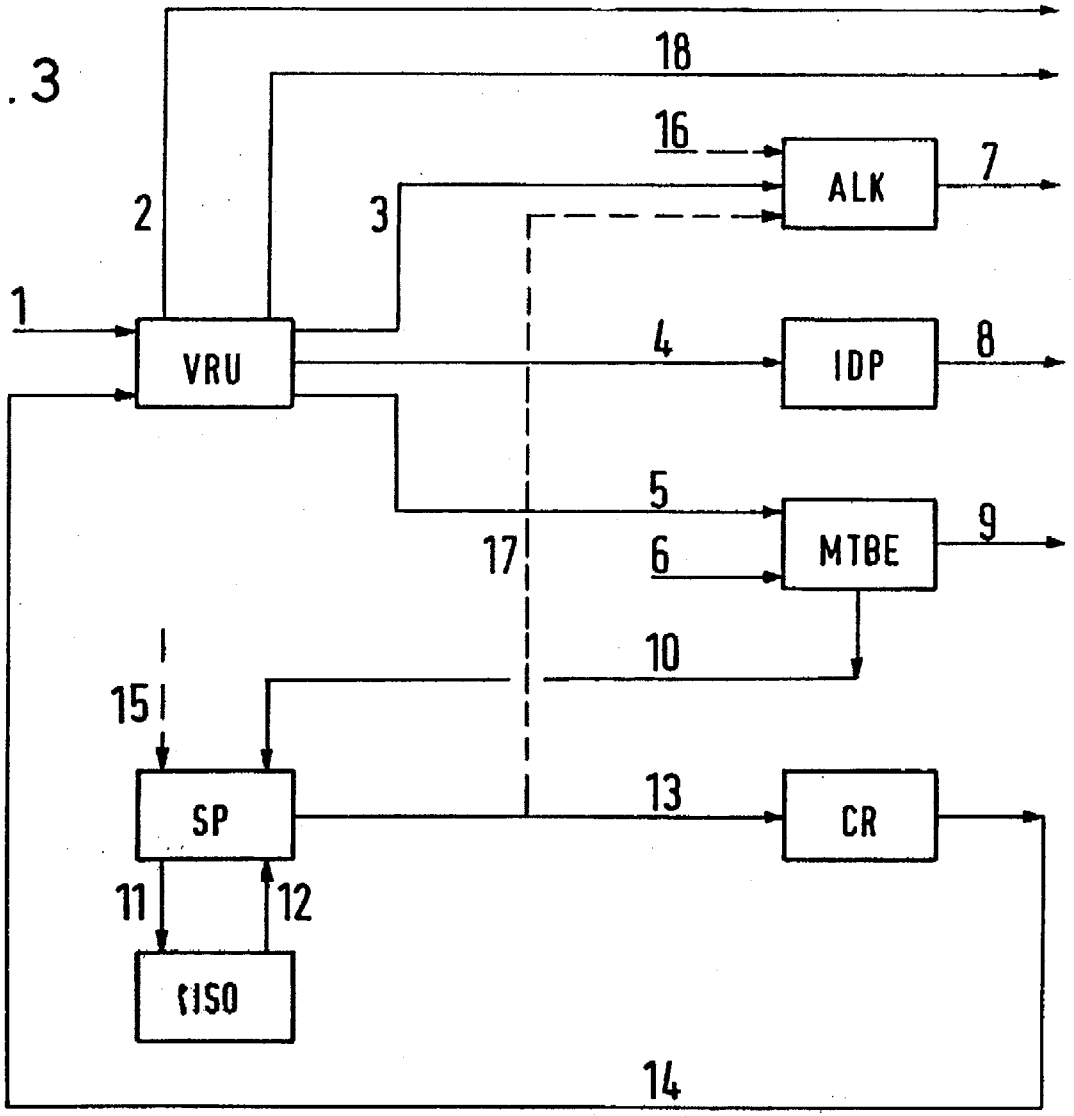
FIG. 3 shows a possible diagram of connections for an inventive extension of the refinery process.

These flows are symbolized in FIG. 3 by arrow 1. The purely gaseous components (particularly $H_2$, $C_1$, $C_2$, CO, $CO_2$) are separated out (arrow 2) before the rest of the components are further processed. This further processing, which is represented for the sake of brevity in FIG. 1 by the unit AIDP, is further divided in FIG. 3 into alkylation ALK and additional processes IDP (isomerization, dimerization, polymerization). In the catalytic alkylation ALK, valuable alkylate gasoline (arrow 7) is produced from a flow 3 which proceeds from the fractionating installation VRU and contains butane as well as butylene and propylene. $C_3$ components, $C_4$ components and $C_5^+$components which have been separated out in the fractionating installation VRU are fed to additional processes IDP with the mass flow 4 and are further processed to form gasoline products S. At least a part of the $C_4$ components, which as a rule contain isobutylene in an order of magnitude of approximately 20 percent by weight, is guided according to the invention as mass flow 5 along with a methanol 6 flow into an installation MTBE for the production of tert-butyl methyl ether. The produced MTBE product flow is designated by 9. Alternatively, it is possible to produce ETBE in the same manner by supplying ethanol instead of methanol. Since only the isobutylene takes part in the conversion to MTBE in the MTBE installation, the proportion of unconverted $C_4$components is subjected to cracking for generating isobutylene.

In the present instance, the flow 10 of $C_4$ components is first guided into a separating device SP in which n-butane is separated from isobutane. The n-butane is fed from the separating device SP into an isomerization ISO (line 11) and is then guided back into the separating device SP again to separate out the isobutane (line 12). The isobutane is formed in the present example in a secondary circuit so that the cracking installation CR in which the isobutane arrives via line 13 is not charged with the proportion of unwanted butane. It is also possible to guide a part of the mass flow 5 directly into the complex for isomerization and isobutylene production, bypassing the MTBE installation.

The cracking installation CR operates according to the thermal cracking process. In the present instance, this is decidedly more advantageous than a catalytic conversion, since, in addition to isobutylene, a thermal cracker in particular also generates considerable quantities of propylene which is very desirable as a particularly valuable saleable product in the refinery process or for subsequent further processing. On the other hand, a catalytic conversion of the isobutane would only produce isobutylene, specifically in such quantities that processing it further to form MTBE (or ETBE) or alkylate gasolines would yield an unnecessarily high amount of the gasoline additive compared to the quantities of the rest of the gasoline products produced. The isobutylene with the unconverted proportion of isobutane is guided from the cracking installation CR to the fractionating installation VRU via the line 14. From there, the circulation of unconverted $C_4$ components can begin again via the MTBE production installation.

In many cases, it is advantageous to guide a partial flow 17 of the isobutane separated out in the separating device SP into the alkylation ALK so as to produce a higher proportion of alkylate gasoline 7 in the latter. This is particularly advisable when additional quantities of butane are to be processed outside the actual refinery process (e.g. from the crude petroleum extraction). This is shown in FIG. 3 by the dashed arrow 15 leading into the separating device SP. The additional butane could also be introduced at another location (e.g. into the VRU installation). Reference is also made to the dashed arrow 16 which shows the possibility of feeding additional partial amounts of isobutane directly into the alkylation ALK from the outside. Finally, reference is made to the flow of various gasoline products ($C_5^+$), designated by 18, which is guided out of the fractionating installation VRU.

The inclusion of MTBE or ETBE production, according to the invention, with linked butane cracking installation in a conventional refinery process makes it possible to exploit the occurring quantities of butane in an optimal manner. In so doing, a particularly valuable gasoline additive (MTBE or ETBE) is produced which, owing to the application of thermal cracking which is unconventional per se, supplies isobutylene in quantities which make it possible to produce quantities of gasoline additive adapted to the requirement of the gasoline product quantities. It is very important in doing so that a quantity of propylene is also formed in this process, as the latter has particular economic value. The refinery process as a whole can be operated with a balance of energy so that it is unnecessary to import or export energy or process steam.

The required technical expansions with respect to the installation are comparatively inexpensive when the value of the producible products is taken into account, so that the payback period for corresponding investments is substantially shorter than in a large-scale MTBE installation with the formerly conventional catalytic cracker. It is particularly advantageous that there is no need to transport surplus butane to MTBE/ETBE installations or to transport the produced MTBE/ETBE back to the refinery for the purpose of mixing with the produced gasoline products.

The efficiency of the process according to the invention is described in more detail with reference to a comparison example according to the prior art and an embodiment example of the invention. The examples are based on a refinery process corresponding to FIG. 1 in which identical quantities (100 percent by weight) of the same crude oil were processed. This resulted in a guantity flow into the fractionation installation VRU having the following composition (in percent by weight of the crude oil input):

| | |
|---|---|
| propylene | 1.50% |
| propane | 1.54% |
| isobutylene | 0.70% |
| n-butylene | 1.70% |
| isobutane | 0.36% |
| n-butane | 2.60% |
| $C_5^+$ | 0.90% |
| | 9.30% |

In the comparison example, a gas flow (propane) of 1.54 percent by weight was separated off by fractionation VRU. The remaining portion was converted by alkylation with an additional directly supplied quantity of 3.47 percent by weight isobutane resulting in a product flow of the following composition (percent by weight):

| | |
|---|---|
| alkylates | 8.46% |
| n-butane | 1.87% |
| $C_5^+$ | 0.90% |
| | 12.77% |

The example according to the invention was carried out with an input flow into the fractionation installation VRU having the same composition and the same direct feed of 3.47 percent by weight isobutane into the alkylation installation. In contrast to the comparison example, however, devices for isomerization of butane, thermal cracking of isobutane, and production of MTBE were provided at the fractionation installation VRU in the sense of FIG. 3. In so doing, 0.54 percent by weight methanol was additionally fed to the MTBE unit. Devices for additional processes IDP as in FIG. 3 were not provided. The quantity flow 14 fed back into the fractionation installation VRU from the thermal cracking installation CR had the following composition (percent by weight):

| | |
|---|---|
| gas | 0.86% |
| propylene | 0.72% |
| propane | 0.04% |
| isobutylone | 0.89% |
| n-butylene | — |
| isobutane | 2.08% |
| n-butane | 0.01% |
| $C_5^+$ | 0.07% |
| | 4.67% |

As a result, a gas quantity ($C_1$–$C_3$) of 2.43 percent by weight was separated out in the fractionation. The product flow from the alkylation installation had the following composition:

| | |
|---|---|
| alkylates | 8.01% |
| n-butane | 0.39% |
| $C_5^+$ | 0.97% |
| MTBE | 1.49% |
| | 10.86% |

Accordingly, the butane content in the end product of 1.87 percent by weight could be reduced to only 0.39 percent by weight, that is, roughly 20% of the original value, by the process according to the invention. At the same time, it was possible to produce a quantity of 1.49 percent by weight of valuable MTBE as gasoline additive, which required an external supply of only 0.54 percent by weight methanol. The quantity of alkylates decreased relatively slightly by approximately 0.4 percent by weight, while the quantity of $C_5^+$products increased by approximately 0.1 percent by weight. The increase in the gas quantity separated out in fractionation by approximately 0.9 percent by weight, i.e. almost 60% of the original value, is particularly significant, since this increase is substantially brought about by additionally generated high-quality propylene.

We claim:

1. A process for refining crude petroleum, comprising the steps of:

(a) generating refinery gas and liquid gas (LPG) and gasolines ($C_5^+$) by distilling the crude petroleum;

(b) splitting the refinery gas, the liquid gas (LPG) and gasolines by fractionation into a gas flow and flows of higher hydrocarbons ($C_3$, $C_4$, $C_5^+$), the higher hydrocarbon flow containing $C_4$ components comprising n-butane, isobutane and isobutylene;

(c) subjecting at least a portion of the higher hydrocarbon flow containing $C_4$ components together with a flow of one of methanol and ethanol to a catalytic reaction for producing one of tert-butyl methyl ether (MTBE) and tert-butyl ethyl ether (ETBE);

(d) separating an unconverted portion of the n-butane containing $C_4$ components from the catalytic reaction;

(e) subjecting said unconverted portion to isomerization for converting a part of the n-butane into isobutane;

(f) subjecting at least a part of the isobutane to thermal cracking for forming isobutylene and propylene; and (g) guiding at least a part of a product flow from the thermal cracking back to the splitting step.

2. A process according to claim 1, including guiding a partial flow of the $C_4$ components past the catalytic reaction and directly introducing the partial flow to step (f) in which the isomerization of the n-butane and step (g) in which the thermal cracking of the isobutane take place.

3. A process according to claim 1, including separating off the unconverted part of n-butane from step (e) and guiding the n-butane back to the isomerization prior to the thermal cracking of the isobutane in step (g).

4. A process according to claim 1, wherein the process includes hydrocracking prior to the fractionation, and further comprising a step of alkylation for converting a portion of at least one of the isobutylene and propylene produced in the thermal cracking process into alkylate gasoline, the alkylation step following the fractionation.

5. A process according to claim 4, including passing a partial flow of the isobutane produced by the isomerization past the thermal cracking and supplying it directly to the alkylation step.

6. An installation for producing one of methyl tert butyl ether and ethyl tert butyl ether from crude petroleum, comprising: means for distilling the crude petroleum; means connected to said distilling means for fractionating of gasolines, refinery gas and liquid gas; a plurality of conveyance lines connected to the fractionating means for permitting removal of gas and higher hydrocarbons; means for catalytically forming one of tert-butyl methyl ether and tert-butyl ethyl ether, a first one of said plurality of lines being provided so as to guide $C_4$ components out of the fractionating means into the catalytic formation means; and production means including an isomerization unit for converting n-butane into isobutane and a thermal cracking unit connected with the isomerization unit for producing isobutylene and propylene, a second of the lines being connected so as to guide unconverted $C_4$ components from the catalytic formation means to the production means, a third of the lines being provided so as to supply a product of the thermal cracking unit to the fractionating means.

7. An installation according to claim 6, and further comprising a bypass line connected between the first line and the second line so as to permit bypassing of the catalytic formation means.

8. An installation according to claim 6, wherein the production means includes a separating means for separating isobutane from n-butane, a fourth line for guiding the separated isobutane into the thermal cracking unit and a fifth line for guiding the n-butane into the isomerization unit.

9. An installation according to claim 8, wherein the second line is connected from the catalytic formation means to the separating device.

10. An installation according to claim 8, and further comprising hydrocracking means and an alkylation device connected to the fractionation means for converting isobutylene and propylene into alkylate gasoline.

11. An installation according to claim 10, wherein a sixth of the lines is provided so that isobutane is guidable out of the separating device directly into the alkylation device while bypassing the thermal cracking unit.

* * * * *